United States Patent [19]

Kiesel

[11] Patent Number: 4,801,845

[45] Date of Patent: Jan. 31, 1989

[54] HALOGEN INCANDESCENT LAMP STRUCTURE

[75] Inventor: Rolf Kiesel, Aalen, Fed. Rep. of Germany

[73] Assignee: Patent Treuhand Gesellschaft für elektrische Glühlampen mbH, Munich, Fed. Rep. of Germany

[21] Appl. No.: 44,048

[22] Filed: Apr. 29, 1987

[30] Foreign Application Priority Data

May 16, 1986 [DE] Fed. Rep. of Germany ..... 3616673

[51] Int. Cl.[4] ..... H01K 1/24; H01K 1/18

[52] U.S. Cl. ..... 313/579; 313/271; 313/272; 313/274; 313/285

[58] Field of Search ..... 313/579, 271, 272, 273, 313/274, 269, 42, 47, 283, 284, 285, 315, 578

[56] References Cited

U.S. PATENT DOCUMENTS

| | | | |
|---|---|---|---|
| 2,006,820 | 7/1935 | Adams et al. | 313/578 X |
| 2,298,929 | 10/1942 | Dailey | 313/278 |
| 2,565,138 | 8/1951 | Leighton | 313/278 |
| 3,441,772 | 4/1969 | Cardwell, Jr. | 313/271 |
| 3,497,753 | 2/1970 | Huston, Jr. | 313/271 |
| 3,909,653 | 9/1975 | Bottone et al. | 313/271 |
| 3,986,067 | 10/1976 | De Fraeye | 313/273 |
| 4,178,050 | 12/1979 | Kiesel et al. | 316/19 |
| 4,302,698 | 11/1981 | Kiesel et al. | 313/316 |
| 4,305,016 | 12/1981 | Schmidt | 313/117 |
| 4,492,893 | 1/1985 | Steiner et al. | 313/579 |
| 4,651,048 | 3/1987 | Liebe | 313/42 |

*Primary Examiner*—Leo H. Boudreau
*Assistant Examiner*—Michael Horabik
*Attorney, Agent, or Firm*—Frishauf, Holtz, Goodman & Woodward

[57] ABSTRACT

To positively position the components of a filament mount, including filaments (6, 7) and a cover cap (11) shrouding a filament, for use in a dual-filament automotive-type lamp, one of the current supply leads (10') is extended towards the exhaust tip (4) of the lamp. A guide element (13), which terminates in an at least essentially part-cylindrical region, is melted-in into the exhaust tip (4), and receives the end portion (12) of the current supply lead. If the element is springy, for example a spiral spring permitting compression, the spring (13) and the current lead wire (10') can be welded together, particularly for lamps which have low thermal loading. In lamps which have high thermal loading, the end (12) of the current lead (10') is preferably received loosely within the spiral spring to minimize heat transfer; additionally, a heat insulating jacket (14), for example in form of a small ceramic tube or a glass coating, can be interposed between the spiral spring (13) and the current supply lead.

13 Claims, 3 Drawing Sheets

(QUARTZ GLASS)

(HARD GLASS)

HALOGEN INCANDESCENT LAMP STRUCTURE

Reference to related patents assigned to the assignee of the present application, the disclosure of which is hereby incorporated by reference: U.S. Pat. Nos. 4,178,050, Kiesel et al.; 4,302,698, Kiesel et al.; 4,305,016, Schmidt.

Reference to related patent publications: German Patent Disclosure Document No. DE-OS 24 00 315, Schönherr, assigned to the assignee of the present application. German Patent Disclosure Document No. DE-OS 28 40 537, Jokie.

The present invention relates to a halogen incandescent lamp, and more particularly to a halogen incandescent lamp structure which has a comparatively heavy internal mount structure, for example including a light covering cap, as used in dual-filament automotive head lamp arrangements, in which an internal support at the pumping tip is provided to improve the internal stiffness of the lamp.

BACKGROUND

Various types of halogen incandescent lamps are used in the automotive industry. It is well known to make halogen incandescent lamps of quartz glass, for example to make such lamps for head lights, fog lights, driving lights and the like. For certain applications, for example for motor cycles, lamps are required which are particularly resistant to shock and vibration, and especially resistant to vibrations which might induce resonance effects within the lamp. It has been proposed to improve the internal structure of the lamp, which includes the filaments and, in a dual-filament lamp, a light shielding cap, by anchoring one of the current supply leads directly in the quartz glass—see, for example, the referenced German Patent Disclosure Document Nos. DE-OS 24 00 315 and 28 40 537. The lamps there disclosed utilize quartz glass, in which the current supply lead which also carries the light shielding cap is embedded. This is possible because of the extremely small thermal coefficient of expansion of quartz. A current supply lead which is directly connected into, for example by being melted into, a tipped-off end of the lamp, used first to evacuate the lamp, then fill the lamp with a fill gas and, tipping it off, may bend during operation of the lamp due to thermal expansion of the current supply lead. The current supply lead need not be melted into the lamp; it may only engage the internal glass wall of the lamp. Bending of the current supply lead, however, deflects the filament from the optical axis, and from perfect alignment therewith. Additionally, it has been found that thermal and mechanical stresses arise particularly, if the current supply lead is melted into the tipped-off end of the lamp. The current supply lead expands due to the operating temperature of the lamp. If the thermal expansion of the current supply lead is excessive, the bulb or envelope of the lamp may form cracks which lead to sealing losses, and eventually destruction of the lamp.

It is desirable to make lamps, particularly lamps for automotive use, not of the very expensive quartz glass but, rather, of hard glass. Hard glass also eliminates the necessity to use the expensive molybdenum foil connection in a press or pinch seal, which is required in quartz glass. Such molybdenum foils are expensive. Molybdenum foils need not be used with lamps made of hard glass—see, for example, the referenced U.S. Pat. Nos. 4,178,050, Kiesel et al; 4,302,698, Kiesel et al; 4,305,016, Schmidt, all assigned to the assignee of the present application. The thermal coefficient of expansion of the hard glasses which are used is about 10 times as high as that of the quartz glass. It is, therefore, not possible to construct lamps in the aforementioned manner which are stable internally, that is, in which the electrode assembly is not subject to vibration or oscillations, and particularly oscillations which might result in resonance, upon being subjected to shock or vibration when installed in a motor vehicle.

THE INVENTION

It is an object to provide a halogen incandescent lamp, and particularly a halogen incandescent lamp having a hard glass bulb or envelope—although the invention is equally applicable to a quartz glass envelope—in which the internal components of the lamp are effectively retained in position so that the internal stability of the structure is improved, without interfering with the quality of the optical imaging of the filament in a reflector; and, more particularly, to provide halogen incandescent lamps for use in vehicular application and especially in which an internal reflector or shielding element is located within the lamp. The lamps may be used not only for vehicular or automotive application but also for other applications, for example as signalling lamps or studio illumination lamps.

Briefly, a hollow essentially cylindrical guide element, for example a spiral spring wire, is secured to and mounted in the exhaust tip of the top portion of a lamp, extending inwardly thereof. A wire element which is part of the electrode lamp mount is extended upwardly towards the hollow element and introduced therein, to be received in the hollow element, for example with clearance, to permit some movement upon dimensional changes due to thermal expansion.

If the hollow cylindrical element is a spiral spring, the wire can be secured to the spiral spring, for example by a weld, the spiral spring permitting resilient acceptance of dimensional changes of the wire. Typically, the wire is part of one of the filament lead-in terminals.

In accordance with a feature of the invention, the hollow cylindrical element, preferably, is a molybdenum or tungsten element. It permits alignment of the filament structure and the lamp mount in the optical axis of the lamp since the thermal expansion of the holding element is directed in the optical axis. The tip of the lamp, of course, and as is customary, is in the optical axis of the lamp.

In accordance with a particularly simple embodiment of the invention, the holding wire element is merely an extension of one of the current supply leads, preferably bent to have an end portion precisely in alignment with the optical axis of the lamp. A spiral spring, used as the hollow cylindrical element, has the additional advantage that any lateral oscillations or vibrations which tend to move the mount from the optical axis will be rapidly damped to return the mount structure, and hence the electrodes, to the optical axis. Such oscillations or vibrations which are unavoidable in an automotive or vehicular environment may be caused due to unevenness in the road surface, inherent oscillations and vibrations of the vehicle and the like. Transmission of heat from the holding wire element to the glass material of the bulb or envelope is especially low when a spiral spring is used. When extremely high heat loading occurs, heat transfer to the glass can be additionally reduced by thermally insulating the end of the holding wire, for example by forming a heat-resistant coating thereon, before introducing the holding wire into the hollow cylindrical element which, preferably, is a spiral spring, one end of which is extended and melted-in into the glass tip of the lamp.

DRAWINGS

FIG. 1*a* and FIG. 1*b* illustrate two prior art structures of halogen incandescent lamps, in which FIG. 1*a* illustrates a structure utilizing hard glass, and FIG. 1*b* a structure utilizing quartz glass;

FIG. 2 is a fragmentary vertical cross-sectional view through a lamp structure in accordance with the present invention; and FIGS. 3, 4 and 5 illustrate, to an enlarged scale, other embodiments of the present invention.

DETAILED DESCRIPTION

Figure 1B:
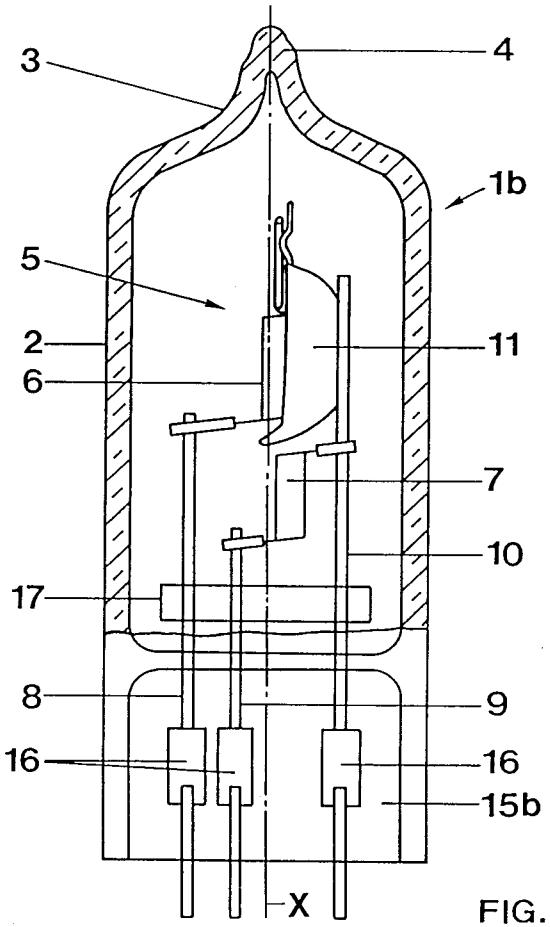
FIG. 1b PRIOR ART
Figure 1A:
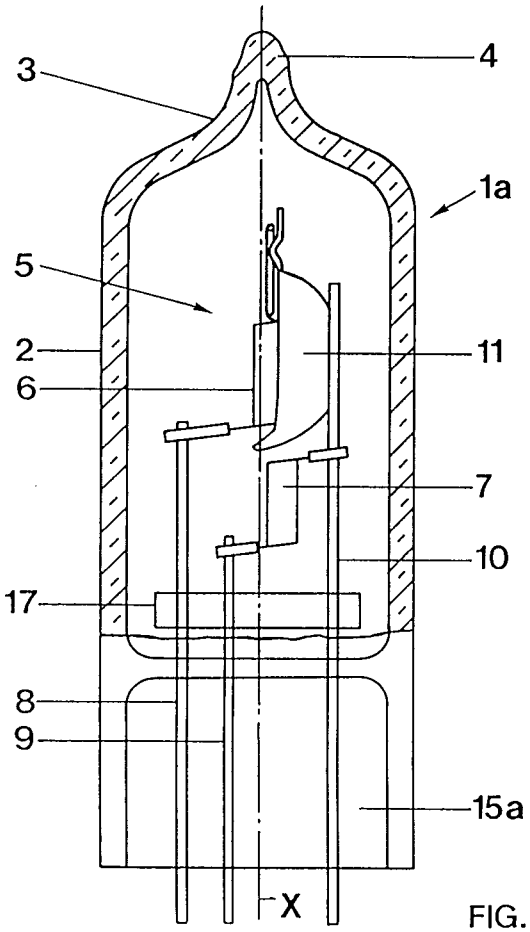
FIG. 1a PRIOR ART

FIGS. 1*a* and 1*b* show prior art halogen incandescent lamps used as dual-filament lamps for vehicular use. The respective lamps 1*a*, 1*b* have bulbs or envelopes 2. The bulb or envelope 2 in the lamp of FIG. 1*a* is made of hard glass. The cap or top element 3 of the lamp has an exhaust tip 4 formed thereon. The bulb or vessel 2 retains a fill of an inert gas, for example nitrogen, argon, crypton, xenon, and a halogen additive. A single-ended pinch seal 15 is formed at the bottom of the lamp. Current supply leads 8, 9, 10 extend through the pinch seal 15. No foil insert is needed. The pinch seal 15*b* of the lamp 1*b* retains molybdenum foils 16, as is well known in halogen incandescent lamp construction.

The internal structure of the lamp includes a mount 5 which has two filaments 6, 7 which, as well known, can be separately energized via three current supply leads 8, 9, 10. The current supply leads are made of molybdenum. As is well known, and as is customary, the current supply leads 8, 9 terminate at respective lower ends of vertically staggered filaments 6, 7. When the lamp is operated under "passing beam" conditions, the upper filament 6 is energized. It is covered or partly shrouded by a cap 11. The third current supply lead 10 is connected directly with the upper end of the lower filament 7. The current lead 10 is likewise connected to the upper end of the upper filament 6 via the cap 11. The cap 11 is supported by the current lead 10, for example by being welded thereto. Ordinarily, the current lead 10 terminates approximately level with the cap 11. The various current supply leads are mounted in position relative to each other and within the lamp by a cross element 17 of quartz.

Except for the material of the glass, and the formation of the pinch seal 15*a*, 15*b*, respectively, and the presence of the molybdenum foil inserts 16, the lamps 1*a* and 1*b* can be identical. As best seen in FIGS. 1*a* and 1*b*, the filament 6 is positioned in approximate alignment with the optical axis X of the respective lamp. The "high beam" filament 7 is slightly offset. The position of the respective filaments with respect to the optical axis is determined by the light pattern which is desired from a headlight when the lamp is installed in a standard reflector; this relative position of the filaments 6, 7 with respect to the axis X should not change.

Figure 2:
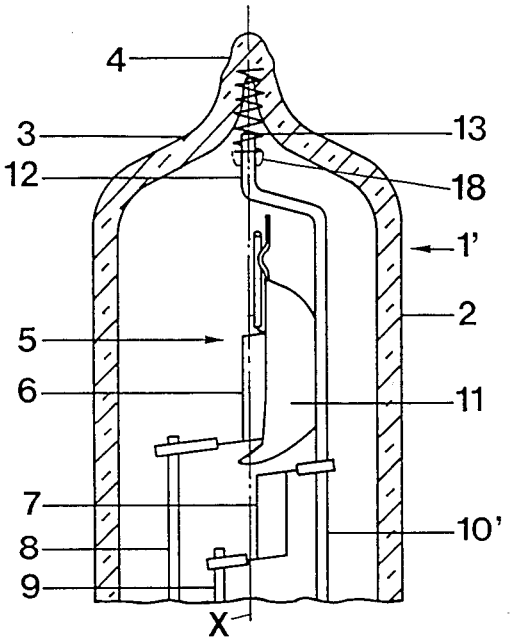

In accordance with the present invention, and as best seen in FIG. 2, the current supply lead 10 is modified. Hence current supply lead 10′ is formed with an extending portion 12 which is bent from the off-center position, as shown in FIGS. 1*a* and 1*b* as well as in FIG. 2, towards the optical axis X and then again bent upwardly and in alignment therewith. The lamp 1′ of FIG. 2 may be a two-filament lamp having a bulb 2 either of hard glass or of quartz glass. The arrangement of the filaments 6, 7 and the current supply leads 8 and 9 can be identical to those shown in FIGS. 1*a* and 1*b*. The third current supply lead 10′, however, and as clearly seen in FIG. 2, is extended beyond the end of cap 11 towards the top portion 3 of the lamp. The end 12, being offset from the off-axial position back to the axis X, is retained in a hollow tubular element which, as shown in FIG. 2, is a spiral spring 13 made of molybdenum having a length of 6 mm and made from a wire with a diameter of 0.3 mm. The end 12 is loosely inserted in the spiral spring 13. This loose engagement insures good thermal isolation. The spiral spring 13 is aligned with the optical axis X of the lamp. It is melted-in into the tipped-off end 4 and extends interiorly of the bulb 2. The third current supply lead 10′ is extended into the spiral spring 13 only to such an extent that it can expand during operation of the lamp, that is, as the lamp becomes hot and, consequently, lead 10′ expands.

It is easier to make the lamp if the spiral spring 13 is connected to the end 12 of the extended lead 10′. If the heat loading of the lamp is low, a weld 18 may be formed between the end portion 12 of the lead 10′ and the spring 13. The weld 18 is made before the mount, including the filaments, supply leads and holding bars 17 are introduced into the lamp. The advantages to be obtained by the present invention are also achieved in this embodiment, since, upon heating and consequent longitudinal expansion of the lead 10′, the spring 13 can compress. This additionally improves the damping effect with respect to lateral deflection of the support 10′, which also holds the cap 11, under severe vibration and shock conditions to which the lamp may be subjected.

Figure 3:
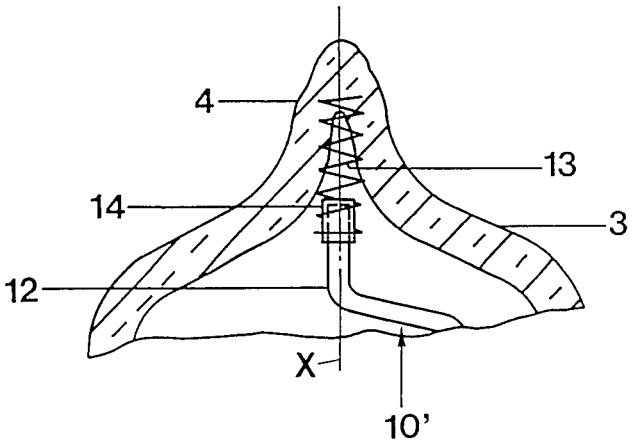

Some halogen incandescent lamps are highly loaded thermally. FIG. 3 illustrates an embodiment in which the end 12 of the lead 10′ is loosely introduced into the interior of the spiral spring 13. To insure that thermal heat transmission between the lead 10′ and spring 13 is a minimum, the end 12 of the lead 10′ is heat-insulated. A heat insulating layer 14 is applied to the end 12 in the region where it is surrounded or will be surrounded upon expansion of the element 10′ by the spring 13. The insulation layer 14 can be a melted-on coating of glass, for example by melting-on a glass bead, or by slipping a ceramic tube over the end 12. The internal diameter of the spring 13 is selected to be sufficiently large to receive the then increased diameter of the current supply lead 10′ in the region where the heat insulation 14 is provided.

Figure 4:
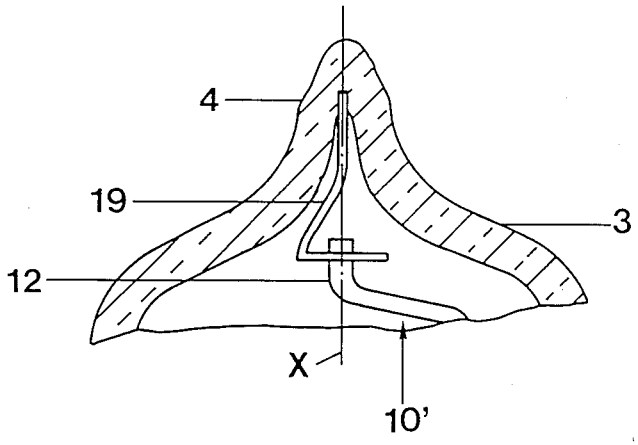

FIG. 4 illustrates an embodiment in which the guide element comprises an angle-plate 19 with conical surface. The tapered end of the plate is melted-in along the optical axis into the tipped-off end 4 of the bulb; the plate is curved away from the optical axis. The part of the plate at the opposite end is angled back towards the optical axis and intersects the optical axis at a right angle. It provides at the point of intersection a hole through which the end portion 12 of the wire 10′ can extend.

Figure 5:
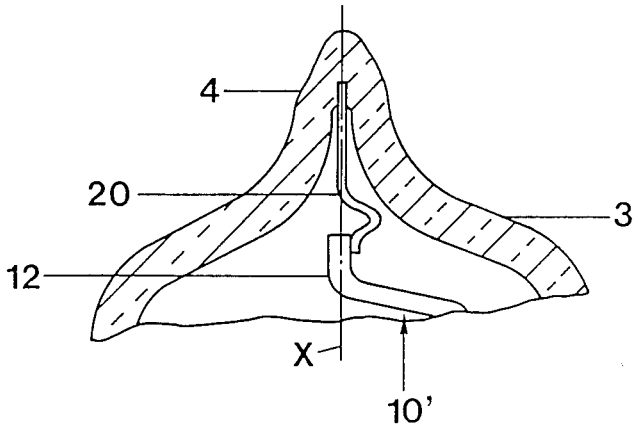

A further embodiment is shown in FIG. 5 in which the end portion 12 of the wire 10′ is coupled to a spring element 20, made from an offset coil spring and being secured to and melted-in into the exhaust tip 4. The spring element 20 permits change in dimension of the wire element 10′ upon thermal expansion thereof in operation of the lamp while retaining the wire element in alignment with the position of the spring element.

Various changes and modifications may be made; the invention is applicable not only to multi-filament lamps but, also, to single-filament lamps, and particularly where rough service, such as exposure to extreme shock and vibration can be expected. The bulb 2 can be of hard glass or quartz glass, as selected.

I claim:

1. Shock-resistant, thermal-change-accepting, halogen incandescent lamp having a bulb or envelope (2) of hard glass or quartz glass;

an exhaust tip (4) formed at a first or top end portion (3) of the bulb;

a fill of an inert gas and a halogen additive;

a mount (5) having at least two current supply leads (8, 9, 10) secured thereto, at least one filament (6, 7) connected to respective current supply leads, and a wire element (10) extending in the direction towards the top portion of the bulb;

a pinch or press seal (**15*a*, 15*b*) closing off the bulb at a second or bottom portion thereof, said current supply leads (8, 9, 10) passing through said pinch or press seal; and means for retaining the mount in fixed position with respect to the pinch or press seal, comprising, a hollow, essentially at least part-cylindrical, guide element (13) secured to and melted into the exhaust tip (4) of the top portion (3) of the bulb and extending into the interior of the envelope or bulb (2), and a holding wire element (10') secured to said mount (5) and having a top portion (12) received within said at least essentially part-cylindrical guide element (13), extending axially thereinto to an extent which permits further extension upon thermal expansion of said holding wire element (10'), said guide element retaining said holding wire element (10') in a predetermined alignment with respect to an optical axis of said lamp, while resiliently accepting dimensional changes of said holding wire element (10'**) resulting from temperature variation during lamp operation, thereby preventing bending of said holding wire element due to thermal expansion and consequent movement of said at least one filament out of predetermined alignment with said optical axis.

2. The lamp of claim 1, wherein the wire element (10') comprises an extended portion of one of said current supply leads (10), terminating in said top portion (12).

3. The lamp of claim 1, wherein said guide element (13) comprises a spring element.

4. The lamp of claim 1, wherein said guide element comprises a spiral spring element.

5. The lamp of claim 4, wherein the interior diameter of said spiral spring element is slightly larger than the outer diameter of said top portion (12) to loosely receive the top portion therein.

6. The lamp of claim 1, further including a heat-resistant, heat-insulating jacket (14) surrounding the top portion (12) of said wire element (10') to provide for heat insulation and heat separation between the wire element (10') and said guide element (13).

7. The lamp of claim 1, wherein said guide element comprises molybdenum or tungsten.

8. The lamp of claim 1, wherein said at least essentially part-cylindrical guide element (13) has a free end portion which is in essential alignment with the optical axis (X) of the lamp;

and the top portion (12) of said wire element (10') is in essential alignment with said optical axis.

9. The lamp of claim 1, wherein the bulb or envelope (2) comprises hard glass.

10. The lamp of claim 1, wherein said guide element (13) comprises a spring element (13);

and wherein the top portion (12) of said wire element (10') is welded (18) to the spring element (13), said spring element permitting compression towards the exhaust tip (4) upon thermal expansion of said wire element (10').

11. The lamp of claim 10, wherein said guide element comprises a spiral spring element (13).

12. The lamp of claim 10, wherein the wire element (10') forms part of the holding structure for at least one of the filaments (6, 7) and said spring element retains the top portion (12) of the wire element (10') in predetermined alignment with respect to the optical axis (X) of the lamp.

13. The lamp of claim 1, wherein one filament (6) is covered by a cap (11).

* * * * *